US005451754A

United States Patent [19]

Reale

[11] Patent Number: 5,451,754

[45] Date of Patent: Sep. 19, 1995

[54] CORONA GENERATING DEVICE

[75] Inventor: Louis Reale, Rochester, N.Y.

[73] Assignee: Xerox Corporation, Stamford, Conn.

[21] Appl. No.: 141,749

[22] Filed: Oct. 27, 1993

[51] Int. Cl.[6] ..... H01T 19/04

[52] U.S. Cl. ..... 250/324; 355/221

[58] Field of Search ..... 250/324, 325, 326; 355/221

[56] References Cited

U.S. PATENT DOCUMENTS

| | | | |
|---|---|---|---|
| 4,086,650 | 4/1978 | Davis et al. | 361/229 |
| 4,265,990 | 5/1981 | Stolka et al. | 430/59 |
| 4,585,320 | 4/1986 | Ahavela et al. | 355/3 |
| 4,585,322 | 4/1986 | Reale | 355/3 |
| 4,585,323 | 4/1986 | Ewing et al. | 355/3 |
| 4,646,196 | 2/1987 | Reale | 361/230 |
| 4,837,658 | 6/1989 | Reale | 361/230 |
| 4,920,266 | 4/1990 | Reale | 250/324 |
| 5,257,073 | 10/1993 | Gross | 355/221 |
| 5,270,741 | 12/1993 | Hosaka et al. | 346/155 |

*Primary Examiner*—Bruce C. Anderson

[57] ABSTRACT

A corona generating device for depositing a negative charge on an imaging surface carried on a conductive substrate held at a reference potential comprising; at least one elongated conductive corona discharge electrode supported between insulating end blocks, means to connect said electrode to a corona generating potential source, at least one element adjacent said corona discharge electrode capable of adsorbing nitrogen oxide species generated when said corona discharge electrode is energized and capable of desorbing nitrogen oxide species when said electrode is not energized, said at least one element being coated with a substantially continuous, thin, uniform, electrically conductive, nonpermeable, substantially nonreactive and noncorroding film of a metal deposited in the amorphous state from the vapor state.

9 Claims, 4 Drawing Sheets

CORONA GENERATING DEVICE

BACKGROUND OF THE INVENTION

The present invention relates generally to charging devices and particularly to charging devices which produce a negative corona for use in an electrostatographic printing apparatus.

In today's electrostatographic printing apparatus a photoconductive insulating member is uniformly charged and subsequently exposed to a light image either by direct exposure through a light lens system or to a laser beam which is electronically controlled to expose the member in non-image areas. The electrostatic latent image so formed is made visible by developing with toner particles to form a powder image on the photoconductive insulating layer which may be subsequently transferred to a copy sheet and permanently affixed thereto by heat and pressure. Following transfer of the toner image, the photoconductive insulating layer may be discharged and cleaned of residual toner for the next imaging cycle.

Various types of charging devices have been used to charge or pre-charge photoconductive insulating layers. A recently developed corona charging device is described in U.S. Pat. No. 4,086,650 to Davis et al., commonly referred to in the art as a dicorotron wherein the corona discharge electrode is coated with a relatively thick dielectric material such as glass so as to substantially prevent the flow of direct current there through. This device has the advantage of providing a uniform negative charge to the photoreceptor and therefore may be used in conjunction with the multilayered electroconductive imaging photoreceptors described in U.S. Pat. No. 4,265,990 to Stolka et al. Briefly, these photoreceptors comprise at least two electrically operative layers, a photogenerating layer or a charge generating layer and a charge transport layer which are typically applied to the conductive layer. For further details of such a layer, attention is directed to the aforementioned patent.

As described in some recent patents, certain difficulties have been observed when using corona charging devices that produce a negative corona. It is believed that various nitrogen oxide species are produced by the corona and that these nitrogen oxide species are adsorbed by solid surfaces. In particular, it is believed that these oxide species are adsorbed by the conductive shield as well as the housing of the corona generating device. The shield may in principle be made from any conductor but is typically made from aluminum and the housing may be made from any of a number of structural plastics such as a glass filled polycarbonate. This adsorption of nitrogen oxide species occurs despite the fact that during operation the corona generating device may be provided with a directed air flow to remove the nitrogen oxide species as well as to remove ozone. In fact, during the process of collecting ozone the air flow may direct the nitrogen oxide species to an affected area of the charging device or even some other machine part. It has also been found that after such exposure when a machine is turned off for extended periods of idleness that the adsorbed nitrogen oxide species gradually are desorbed, that is the adsorption is a physically reversible process. It should be understood that the adsorbed and desorbed species are both nitrogenous but not necessarily the same, i.e., there may be conversion of $NO_2$ to $HNO_3$. Then, when the operation of the machine is resumed, a copy quality defect is observed in the copies produced in that a line image deletion or lower density image is formed across the width of the photoreceptor at that portion of its surface which was at rest opposite the corona generating device during the period of idleness. While the mechanism of the interaction of the desorbed nitrogen oxide species and the photoreceptor layers is not fully understood, it is believed that they in some way interact with the surface of the photoreceptor increasing the lateral conductivity so that it cannot retain a charge in image fashion to be subsequently developed with toner. This basically causes narrow line images to blur or to wash out and not be developed as a toner image. This defect has been observed with conventional selenium photoreceptors which generally comprise a conductive drum substrate having a thin layer of selenium or alloy thereof vacuum deposited on its surface as the imaging surface as well as with the multilayered electroconductive imaging photoreceptors described in the aforementioned U.S. Pat. No. 4,265,990.

Furthermore, with prolonged exposure of the photoreceptor to the desorbing nitrogen oxide species during extended periods of idleness the severity of the line defect or line spreading increases. While the mechanism is not fully understood it has been observed that even after a relatively short exposure period of time, 15 minutes, and a period of idleness of, say, several hours, a mild line defect and concurrent image deletion may be perceived. During the initial stage of exposure of the photoreceptor to the desorbing nitrogen oxide species, it is possible to rejuvenate the photoreceptor by washing with alcohol since reaction between the photoreceptor and the nitrogen oxide species is purely at the surface. However, after a prolonged exposure period of time the reaction tends to penetrate the photoreceptor surface layer and cannot be washed off with the solvent. Thus, for example, the problem is perceived after a machine has been operated for about 10,000 copies, rested overnight and when the operator activates the machine the following morning, the line deletion defect will appear. As indicated above the defect is reversible to some degree by a rest period. However, the period involved may be of the order of several days which to an operator is objectionable.

Similar difficulties are encountered in a corotron with a negative potential applied. Attempts to solve that problem by coating the corotron with a thin conductive dry film of aluminum hydroxide containing conductive particles are described in my U.S. Pat. No. 4,837,658 which is hereby incorporated by reference herein.

Several recent patents are directed to approaches to minimizing or solving these difficulties. In particular, U.S. Pat. No. 4,585,320 to Altavela et al. proposes plating the elements capable of adsorbing nitrogen oxide species with a thin layer of lead. U.S. Pat. No. 4,585,323 to Ewing et al. suggests the use of a continuous thin layer of a paint containing a reactive metal such as nickel, lead, copper, silver and zinc on the surfaces which adsorb the nitrogen oxide species. My own U.S. Pat. No. 4,585,322 provides an alkali metal silicate coating on the elements capable of adsorbing and neutralizing the nitrogen oxide species. Further, my own U.S. Pat. Nos. 4,646,196 and 4,920,266 teach coating the elements capable of adsorbing and neutralizing the nitrogen oxide species with a dry film of aluminum hydroxide or a dry film of aluminum hydroxide containing graphite and powdered nickel respectively.

All of the above coatings are capable of minimizing or solving the problem to varying degrees for varying periods of time. The coatings described in the last two mentioned of my prior patents are effective in minimizing the problem in the smaller, slower low volume machines. However, difficulties are experienced in the larger, much faster higher volume machines, wherein, it is desired that the corona charging devices have a life in excess of a million prints if not to the end of the functional life of the machine. Accordingly, corona generating devices which function for 30,000 to 40,000 prints such as those described in the last two aforementioned patents which have films of aluminum hydroxide provided on the corona generating device are consumed too quickly in the higher speed, higher volume product.

While not wishing to be bound to any particular theory, it is believed that this failure occurs by the conversion of $NO_x$ effluents and water vapor to $HNO_3$ by products on the coatings surface during the operation of the corona generating device. It is also believed that the coatings provided in the above enumerated patents are consumed by the nitric acid like effluents over time thereby prematurely degrading it's performance and leading to the deletion difficulties.

It is further believed that the grain boundary is the most chemically reactive region in a given metal's micro structure which would provide the active sites for reaction of the $NO_x$ type of effluents and water vapor to $HNO_3$.

SUMMARY OF THE INVENTION

In accordance with the present invention an improved long-life corona generating device for depositing negative charge on an imaging surface is provided.

In accordance with a principle aspect of the present invention an element adjacent to corona discharge electrode, which is capable of adsorbing nitrogen oxide species generated by the negative corona discharge electrode is coated with a substantially continuous, thin, uniform, electrically conductive, nonpermeable, substantially nonreactive and noncorroding film of a metal deposited in the amorphous state from the vapor state.

In a further aspect of the present invention the metal film is atomically tightly packed and substantially free of grain boundaries.

In a further aspect of the present invention the film is at least 2,000 nanometers, and preferably 5,000 nanometers in thickness.

In a further aspect of the present invention the metal film is sputtered.

In a further aspect of the present invention the metal is selected from the group of titanium and stainless steel and is preferably titanium.

For a better understanding of the invention as well as other aspects and further features thereof, reference is had to the following drawings and descriptions.

DESCRIPTION OF THE PREFERRED EMBODIMENTS

Figure 1:
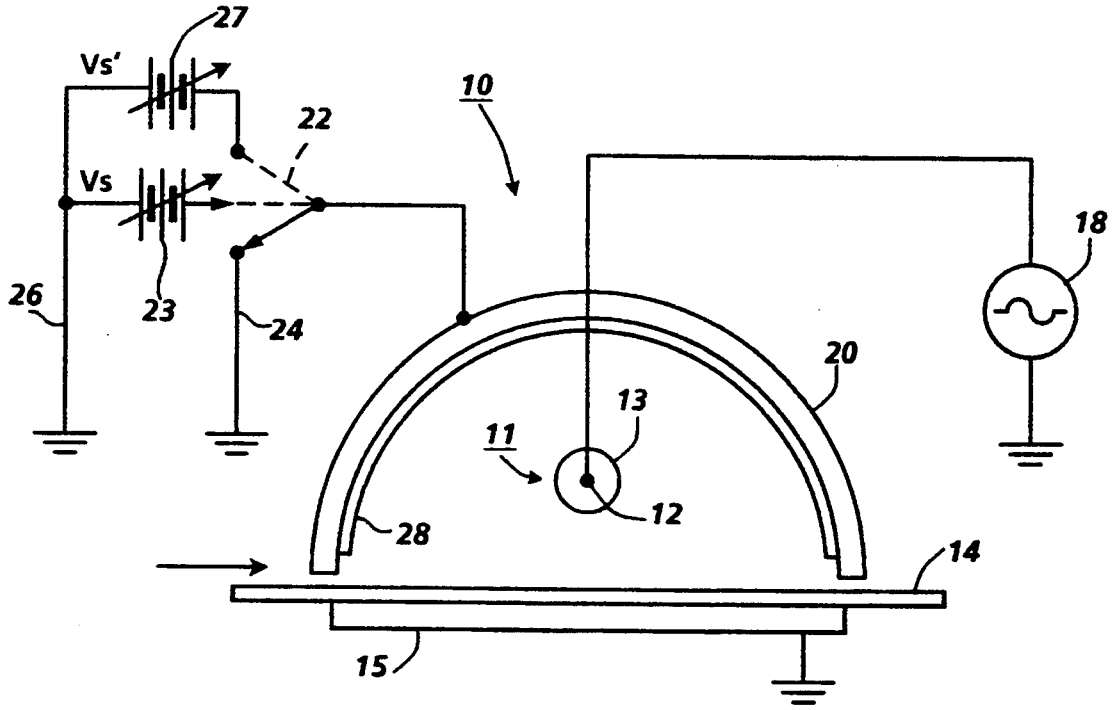
FIG. 1 is an illustrative cross section of a corona discharge device according to the present invention.

Referring to FIG. 1 the corona generator 10 of this invention is seen to comprise a corona discharge electrode 11 in the form of a conductive wire 12 having a relatively thick coating 13 of dielectric material.

A charge collecting surface 14 is shown which may be a photoconductive surface in a conventional xerographic systems. The charge collecting surface 14 is carried on a conductive substrate 15 held at a reference potential, usually machine ground. An AC voltage source 18 is connected between the substrate 15 and the corona wire 12, the magnitude of the AC source being selected to generate a corona discharge adjacent the wire 12. A conductive shield 20 is located adjacent the corona wire on the side of the wire opposite the chargeable surface.

The shield 20 has coupled thereto a switch 22 which depending on its position, permits the corona device to be operated in either a charge neutralizing mode or a charge deposition mode. With the switch 22 as shown, the shield 20 of the corona device is coupled to ground via a lead 24. In this position, no DC field is generated between the surface 14 and the shield 15 and the corona device operates to neutralize over a number of AC cycles any charge present on the surface 14.

With switch 22 in either of the positions shown by dotted lines, the shield is coupled to one terminal of a DC source 23 or 27, the other terminals of the sources being coupled by lead 26 to ground thereby establish a DC field between the surface 14 and the shield 20. In this position, the corona operates to deposit a net charge onto the surface 14, the polarity and magnitude of this charge depends on the polarity and magnitude of the DC bias applied to the shield 20.

The corona wire 13 may be supported in conventional fashion at the ends thereof by insulating end blocks (not shown) mounted within the ends of shield structure 20. The wire 12 may be made of any conventional conductive filament material such as stainless steel, copper, tungsten, platinum or the like and may be plated with gold. The diameter of the wire 11 is not critical and may vary typically between 0.5 to 15 mils and preferably is about 9 mils.

Any suitable dielectric material may be employed as the coating 13 which will not break down under the applied corona AC voltage, and which will withstand chemical attack under the conditions present in a corona device. Inorganic dielectrics have been found to perform more satisfactorily than organic dielectrics due to their higher voltage breakdown properties, and greater resistance to chemical reaction in the corona environment.

The thickness of the dielectric coating 13 used in the corona device of the invention is such that substantially no conduction current or DC charging current is permitted therethrough. Typically, the thickness is such that the combined wire and dielectric thickness falls in the range from 7 to 30 mils. with typically dielectric thickness of 2 to 10 mils. Glasses with dielectric breakdown strengths above 2 KV/mil at 4 KHz and in the range of 2 to 5 mil thickness have been found by experiment to perform satisfactorily as the dielectric coating material. As the frequency or thickness go down, the strength in volts per mil will usually increase. The glass coating selected should be free of voids and inclusions and make good contact with or wet the wire on which it is deposited. Other possible coatings are ceramic materials such as alumina, zirconia, boron nitride, beryllium oxide and silicon nitride. Organic dielectrics which are sufficiently stable in corona may also be used.

The frequency of the AC source 18 may be varied widely in the range from 60 Hz commercial source to several megahertz. The device has been operated and tested at 4 KHz and found to operate satisfactorily.

The shield 20 is shown as being semi-circular in shape but any of the conventional shapes used for corona shields in xerographic charging may be employed. In fact, the function of the shield 20 may be performed by any conductive member, for example, a bare plate, in the vicinity of the wire, the precise location not being critical in order to obtain satisfactory operation of the device.

With the switch 22 connected as shown so that the shield 20 is grounded, the device operates to inherently neutralize any charge present on the surface 14. This is a result of the fact that no net DC charging current passes through the electrode 11 by virtue of the thick dielectric coating 13 and the wire 12.

Referring to FIG. 1, operation of the corona device of the invention to deposit a specific net charge on an imaging surface is accomplished by moving switch 22 to one of the positions shown in dotted lines, whereby a DC potential of either positive polarity or negative polarity with respect to the surface 15 may be applied to the shield.

In charging operation, typical AC voltages applied to the corona electrodes are in the range from 4 KV to 7 KV at a frequency between 1 KHz and 10 KHz. With the conductive substrate of the imaging member being held at ground potential a negative DC bias of from about 800 volts to about 4 KV is applied to the shield. For further details of the manner of operation of the above described dicorotron device, attention is directed to U.S. Pat. No. 4,086,650 to Davis et al.

Referring once again to FIG. 1, the shield 20 is coated at least on its top with a substantially continuous, thin, uniform, electrically conductive nonpermeable, substantially nonreactive, noncorroding film of a metal deposited in the amorphous state from the vapor state. By ensuring that the film is continuous, thin, uniform and nonpermeable it is assured that no pores, holes or gaps exist in the film that enable the nitrogen oxide species to be adsorbed by the underlined substrate. The film may be characterized as being noble in nature because it is both a substantially nonreactive and a noncorroding film. While the film is generally characterized as being amorphous it is not 100 percent amorphous in that there is some small amount of microcrystalline structure present in the film. However, this microcrystalline structure is of a crystalline domain of the order of nanometers compared to the much larger normal crystalline boundaries and therefore provides a substantially amorphous film which is substantially free of grain boundaries. As previously discussed, it is believed that the grain boundary is the most chemically reactive region in the metals used in prior art practices which provide active reactive sites for conversion of the nitrogen oxide species to nitric acid. By providing an amorphous film which is substantially free of grain boundaries, these reactive sites where the conversion of the nitrogen oxide species could take place are eliminated. Thus, it is believed that the amorphous film lacks sufficient number of active grain boundary sites of sufficient energy to enable the reaction between the nitrogen oxide species and water to be initiated and to permit its continuance.

These amorphous films are typically formed from the vapor state which enable a very tough coating with good adhesion properties and substantially no grain boundaries where the film is atomically tightly packed to provide a tightly packed atomic arrangement of the metal atoms. Typical metals capable of forming the amorphous films from the vapor state include titanium, stainless steel and other metals that are very substantially unreactive and noncorroding in the corona environment. It is of course desired that they be environmentally safe and inexpensive. Titanium is preferred because during the preferred sputtering process only one target is required where other materials will require more targets. Stainless steel, for example, requires both an iron and a tungsten target. The unreactive amorphous films are at least 2,000 nanometers in thickness and preferably at least 5,000 nanometers in thickness to ensure a continuous nonpermeable noble film. While there is no theoretical upper limit to the thickness of the film as a practical matter due to size as well as expense the thickness will not exceed the above limits by an appreciable degree. By depositing the films from the vapor state and by controlling the conditions of depositions such as temperature, pressure and deposition rate one is able to ensure a thin amorphous film with a minimal amount of microcrystalline structure. Typically, the films can be manufactured by physical vapor deposition techniques which include evaporation and magnetron and RF sputtering. Sputtering is preferred because it provides a dense coating at low temperature Sputtering is a technique well known in the art. For further information, attention is directed to "Vacuum Thin Films and Sputtering", An Introduction by R. V. Stuart, Academic Press, N.Y. 1983, Chapter IV. Briefly, in the sputtering process, if a solid or liquid at any temperature is subjected to bombardment by high energy atomic particles, usually ions, it is possible for individual atoms to acquire enough energy via collision processes to escape from the surface. These ejected atoms ejected from a surface by sputtering can be used in depositing a coating on a substrate. Any suitable energetic atomic particle impinging against a surface can cause sputtering. It is most convenient to accelerate ions to energies suitable for sputtering so the process is commonly referred to as ion bombardment. In sputtering, typically a metal target is bombarded with high energy atomic particles such as a gas. Typical gases include inert gases such as argon which do not normally react with the target as in Example III described herein after and other somewhat reactive gases such as nitrogen which may form an amount of a reaction product such as titanium nitride as well as titanium as in Examples II and IV described hereinafter. Magnetron sputtering is a conventional system which utilizes strong magnets to enhance plasma generation in order to get higher deposition rates.

Figure 2:
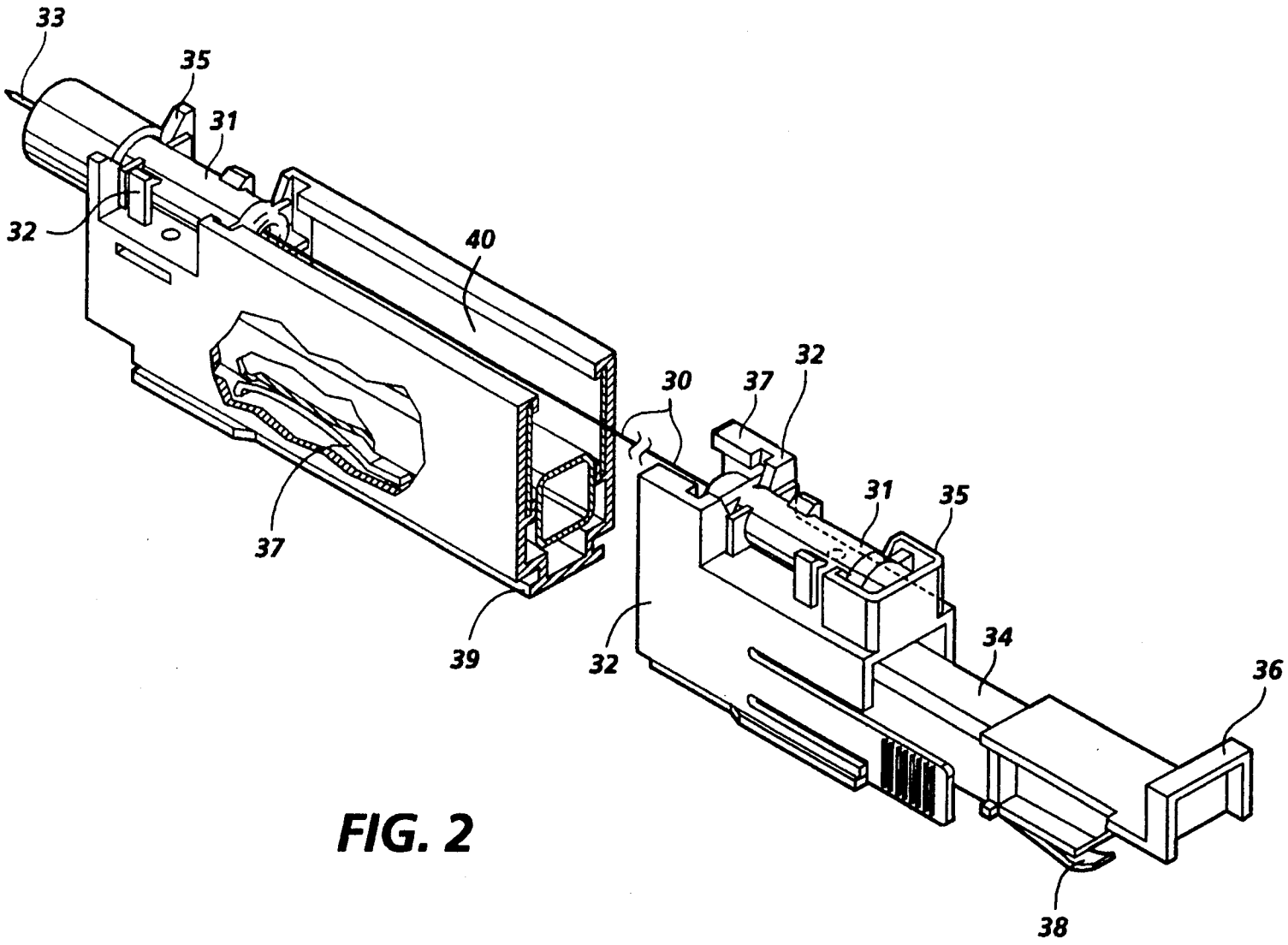
FIG. 2 is an isometric view of a preferred embodiment of a dicorotron according to the present invention.

FIG. 2 illustrates a preferred embodiment in the dicorotron device according to the present invention. In FIG. 2 the dicorotron wire 30 is supported between anchors 31 at opposite ends which are anchored in end blocks 35. The conductive shield 34 is constructed in tubular fashion in such a way as to be slideably mounted in the bottom of the housing 39 by means of handle 36. The shield is connected to the power supply through a sliding contact on its inner surface to a leaf spring which in turn is connected to a DC pin connector (not shown). The power supply potential may be positive, negative, or zero (grounded) depending on device function. It is fastened in place when inserted within the housing 39 by means of spring retaining member 38. When inserted in the machine high voltage contact pin 33 provides the necessary contact to the AC power supply. In addition to the conductive shield 34 the housing 39 comprises two vertically extending side panels 32 extending the entire length of the dicorotron wire. Both the top and inner surfaces of the shield 34 may have a substantially continuous, thin, uniform, electrically conductive, nonpermeable, substantially nonreactive and noncorroding film of a metal deposited in the amorphous state from the vapor state. In addition, the vertically extending panels 32 of the housing 39 may also be coated with a film 40 according to the present invention. The housing 39 together with the side panels 32 may be made to form a single one piece molding from any suitable material such as glass filled polycarbonate.

Figure 3:
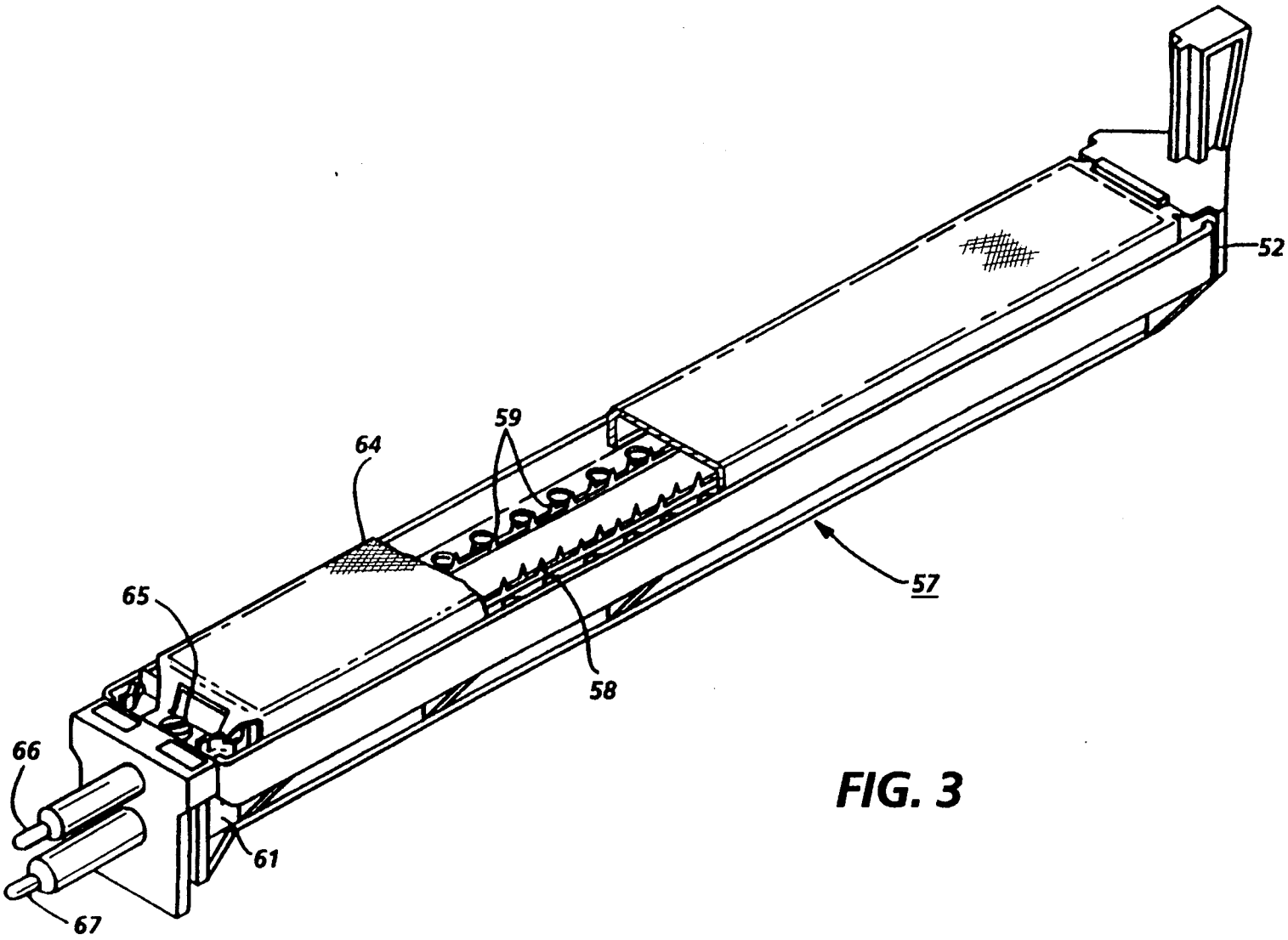
FIG. 3 is an isometric view of another preferred embodiment of a scorotron according to the present invention.
Figure 4:
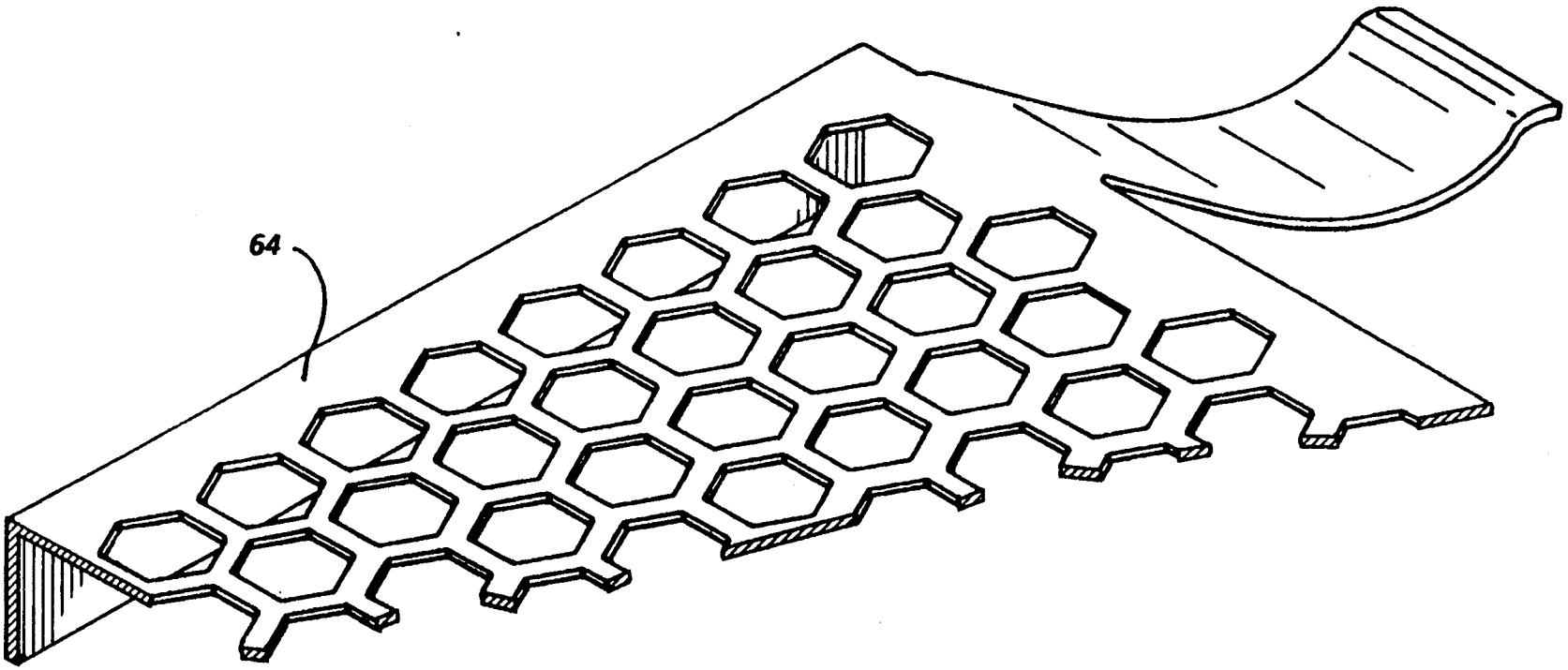
FIG. 4 is an enlarged view of the control grid used in the scorotron illustrated in FIG. 3.

FIGS. 3 and 4 illustrate alternative preferred embodiments according to the present invention which embody use of the present invention in coating the conductive corona control grid of a scorotron. In FIG. 3, scorotron 57 is represented as including two linear pin electrode arrays 58 and 59 supported between insulating end block assemblies 61 and 62. The conductive corona control grid 64 is placed on top of the linear pin arrays and anchored in place by means of screw 65 to potential generating source by lead 66. Both of the linear pin electrode arrays 58 and 59 are connected to potential generating source 67. Such a device might have utility as a negative charging corona generating device wherein the potential from a high voltage DC power supply applied to the grid is about 800 volts or very close to the voltage desired on the imaging surface which is closely spaced therefrom. The potential applied to the two linear pin electrode arrays is in the range of from about 6,000 to about 8,000 volts. The entire assembly is supported by being clamped between three injection molded plastic support strips. In this configuration the two linear pin coronodes in the shape of a saw tooth provide vertically directional fields and currents due to their geometry providing a higher efficiency of current to the photoconductor versus the total current generated. The grid acts as a leveling device or reference potential limiting the potential on the substrate being charged. In accordance with the present invention, the grid may be coated with a substantially continuous, thin, uniform, electrically conductive nonpermeable, substantially nonreactive and noncorroding film of a metal deposited in the amorphous state from the vapor state. In a preferred embodiment of the present invention the grid is fabricated from a copper alloy because of their potential for varied physical properties. Typically, beryllium is present in the alloy in an amount of from about 0.1% to about 2.0% by weight. A preferred alloy is Copper Development Associates 172 (CDA 172) which is 1.8% by weight beryllium. In a particularly preferred embodiment the pin electrodes are also made of the same beryllium copper alloys.

The invention will be further illustrated with reference to the following Examples. Example I is presented for comparative purposes while Examples II, III and IV are according to the invention.

EXAMPLE I

A control grid for a pin scorotron made of conventional crystalline photoelectrical stainless steel similar to that depicted in FIG. 5 generally negative corona was evaluated in a prototype Xerographic copier operating at 80 copies per minute. The grid was adjacent a photoreceptor belt as described in U.S. Pat. No. 4,265,990. After 9.9 thousand prints, print deletion on the photoreceptor began to occur after periods of idleness greater than 20 minutes.

EXAMPLE II

The procedure of Example I was repeated except that the control grid had applied thereto by sputtering a titanium target with nitrogen gas, a thin amorphous coating greater than 2000 nanometers thick of titanium together with titanium nitride. Using the same test procedure as in Example I on a first sample the first print deletion on the photoreceptor was observed at 34.8 thousand prints and on a second sample at 43.3 thousand prints. Both sample grids were removed from the copier and washed thoroughly in plain water while brushing with a tooth brush. They were subsequently placed back in the prototype copier and the testing resumed. Print deletion on the photoreceptor was subsequently observed after an additional about 60 thousand prints per sample.

EXAMPLE III

The procedure of Example I was repeated except that the control grid had applied thereto by simultaneously sputtering an iron target and a tungsten target with argon gas to form a thin amorphous coating of glossy stainless steel. Using the same test procedure as in Example I on a first sample the first print deletion on the photoreceptor was observed at 33.5 thousand prints and on a second sample at 25.7 thousand prints.

EXAMPLE IV

The procedure of Example I was repeated except that the pin scorotron grid was made of stamped beryllium copper alloy available from Copper Development Associates under the designation 172 which had applied to it by sputtering a thin amorphous coating of titanium together with titanium nitride as described in Example II. The grid was evaluated in the Xerox 5100 copier operating at about 100 copies per minute. After 90 thousand prints, print deletion on the photoreceptor began to occur. The grid was removed and washed as in Example II, placed back in the copier and testing resumed. Print deletion on the photoreceptor was subsequently observed shortly before termination of the test after an additional 90 thousand prints.

Thus, according to the present invention, a substantial extension in the useful life of a negative corona generating device has been achieved.

All the patents and other documents referred to herein are hereby incorporated by reference in their entirety in the instant specification.

While the invention has been described with reference to specific embodiments, it will be apparent to those skilled in the art that many alternatives, modifications and variations may be made. For example, while the invention has been illustrated as useful in making prints from a copying device, it will be understood that it has equal application to the making of prints in printer applications wherein the images are created electronically. It is intended to embrace such modifications and alternatives as may fall within the spirit and scope of the appended claims.

I claim:

1. A corona generating device for depositing a negative charge on an imaging surface carried on a conductive substrate held at a reference potential comprising;

at least one elongated conductive corona discharge electrode supported between insulating end blocks, means to connect said electrode to a corona generating potential source, at least one element adjacent said corona discharge electrode capable of adsorbing nitrogen oxide species generated when said corona discharge electrode is energized and capable of desorbing nitrogen oxide species when said electrode is not energized, said at least one element being coated with a substantially continuous, thin, uniform, electrically conductive substantially nonreactive and noncorroding, nonpermeable film of a metal deposited in the amorphous state from the vapor state.

2. The corona generating device of claim 1 wherein said metal film is sputtered.

3. The corona generating device of claim 1 wherein said metal film is atomically tightly packed and substantially free of grain boundaries.

4. The corona generating device of claim 1, wherein said film is greater than 2000 nanometers in thickness.

5. The corona generating device of claim 4 wherein said film is greater than 5000 nanometers in thickness.

6. The corona generating device of claim 1, wherein said at least one element comprises a conductive corona control grid.

7. The corona generating device of claim 1 wherein said metal is selected from the group consisting of titanium and stainless steel.

8. The corona generating device of claim 7 wherein said metal is stainless steel.

9. The corona generating device of claim 7 wherein said metal is titanium.

* * * * *